United States Patent [19]

Adam

[11] 4,190,156

[45] Feb. 26, 1980

[54] METHOD OF PACKAGING UNVULCANIZED NEOPRENE

[75] Inventor: Alain C. Adam, Louisville, Ky.

[73] Assignee: E. I. Du Pont de Nemours and Company, Wilmington, Del.

[21] Appl. No.: 946,713

[22] Filed: Sep. 28, 1978

[51] Int. Cl.[2] ..... B65D 85/70

[52] U.S. Cl. ..... 206/447; 206/460; 206/524.7; 53/469; 206/813

[58] Field of Search ..... 206/524.7, 83.5, 447, 206/460, 813; 53/469

[56] References Cited

U.S. PATENT DOCUMENTS 2,639,808 5/1953 Barry et al. ..... 206/447

3,775,933 12/1973 Prescott et al. ..... 206/83.5

*Primary Examiner*—William T. Dixson, Jr.

[57] ABSTRACT

Solid, unvulcanized neoprene pieces are packed in thermoplastic bags compatible with neoprene; the bags are closed by means of a compatible synthetic polymer stitch, coated on one of their large surfaces with a hot melt adhesive for easy stacking on a pallet, and are delivered directly to rubber compounding equipment, where the bags are shredded, while neoprene is being compounded. In this manner, opening and emptying of kraft paper bags is avoided. Typical thermoplastic bags are made of low density polyethylene and the thread of polyvinyl alcohol.

6 Claims, No Drawings

METHOD OF PACKAGING UNVULCANIZED NEOPRENE

BACKGROUND OF THE INVENTION

This invention relates to a method of packaging unvulcanized, solid neoprene pieces.

The term "neoprene" is generally understood in the art to mean homopolymers and copolymers of chloroprene with other ethylenically unsaturated monomers, wherein chloroprene constitutes at least the predominant monomer.

Neoprene is commercially available as unvulcanized, solid polymer in the form of chips, grains, and chunks of various shapes. Purchasers compound commercial neoprene with fillers, stabilizers, pigments, vulcanizing agents, accelerators, and inhibitors in blenders or mixers of various types, the most common being the Banbury mixer. The compounded neoprene is then fabricated and cured. Neoprene pieces are normally delivered to the blending equipment by means of automated equipment, which requires smooth and even flow of material. Because unvulcanized neoprene is tacky, it is necessary to treat its surface so as to reduce its tackiness to prevent agglomeration. This usually means that neoprene pieces are covered with talc.

Commercial neoprene normally is sold in bags weighing 25 kg. While paper bags are normally used, the labor required for opening and emptying the bags and the necessity of disposing of empty bags add cost and inconvenience to an otherwise simple operation. The problem can be solved by using plastic bags, which can be delivered to blending equipment unopened, so long as the type and amount of the plastic material does not adversely affect the properties of cured neoprene articles. It has been found, however, that is is impossible or difficult to heat-seal plastic bags containing talc-treated neoprene pieces. Apparently, the talc interferes with the normal bag sealing process.

It thus becomes necessary to devise another bag closing means, which would not suffer from this difficulty. Furthermore, it is necessary to provide some bag-retaining means, which would allow polymer-containing plastic bags to be stacked on pallets and handled by fork-lifts without sliding off the pallets.

SUMMARY OF THE INVENTION

According to this invention, there is provided a method and a means of packaging talc-treated, solid neoprene pieces, said means comprising a bag made of a thermoplastic material compatible with neoprene, said bag having on a portion of one of its large surfaces a coating of a hot melt adhesive, the opening of said bag being closeable by means of a compatible synthetic polymer thread stitch.

DETAILED DESCRIPTION OF THE INVENTION

The term "compatible" as used in the Summary of the Invention means that the polymeric material from which the bag or the thread is made is readily dispersible in neoprene in blending equipment at the blending temperature to give a homogeneous dispersion, without causing imperfections and irregularities of cured neoprene. For the purpose of this disclosure, it is sufficient that those polymeric materials be compatible with neoprene at the weight levels at which they are used.

Among suitable materials for making bags are low density polyethylene, an ionomeric resin such as Du Pont's SURLYN ®, and a proprietary film of unknown composition sold by Goodyear under the name "Elastifilm." Other hydrocarbon or modified hydrocarbon polymers may be suitable, provided they have sufficient strength and flexibility for packaging and handling and will readily shred in mixing equipment. The preferred bag material is low density polyethylene because of its low price and good physical properties. The preferred thread material is polyvinyl alcohol. While the melting point of polyvinyl alcohol used in commercial thread is about 213° C., above the normal handling and processing temperatures, polyvinyl alcohol thread has sufficiently low strength to break and disperse readily in the polymer at the blending stage. Commercial polyvinyl alcohol yarn made in Japan by the Nitvy Company, Ltd. (Tokyo), is available in the United States under the trade name "SOLVRON" from Reliable Yarn & Trimming Company, Maspeth, N.Y.

The thickness of the film from which the bags are made is usually about 0.13 mm. Film up to about twice as thick can be used but thicker film than 0.25 mm is not recommended because of danger of significant contamination of neoprene as well as of increased cost.

The polymeric thread can be used in any convenient diameter. The usual thread has the weight of 0.1 g/m. Stitching the polymeric bag is done with commercial bag-stitching equipment.

One or more strips of a hot melt adhesive are applied from a gun-type applicator to one large side of the bag to hold the bags in place on a pallet. A suitable hot melt adhesive is, for example, a copolymer of ethylene and vinyl acetate.

Chloroprene polymers packaged according to the process of the present invention can be vulcanized according to normal neoprene vulcanization techniques and give vulcanizates having very good mechanical properties, so long as reinforcing fillers are used in the recipe. These include, for example, carbon black, hard clay, precipitated silica, fine talc, and calcium silicate.

This invention is now illustrated by the following examples of certain preferred embodiments thereof, where all parts, proportions, and percentages are by mass. Examples 1, 5, and 9 are control examples. Examples 2–4 are to be compared with 1, Examples 6–8 with 5, and 10–11 with 9.

EXAMPLES 1–4

A commercial neoprene blend containing polychloroprene, a copolymer of chloroprene with 2,3-dichlorobutadiene-1,3 and a small amount of naphthenic oil was compounded according to the following recipe which included the amount of packaging material that would be used in the proposed package. The following proportions of materials were present per 100 parts of polymer.

| | Example | | | |
|---|---|---|---|---|
| | 1 | 2 | 3 | 4 |
| FEF black | 22.5 | 22.5 | 22.5 | 22.5 |
| SRF black | 22.5 | 22.5 | 22.5 | 22.5 |
| Aromatic oil | 8 | 8 | 8 | 8 |
| ZnO | 5 | 5 | 5 | 5 |
| Octylated diphenylamine | 2 | 2 | 2 | 2 |
| MgO | 4 | 4 | 4 | 4 |
| Benzothiazyl disulfide | 0.75 | 0.75 | 0.75 | 0.75 |
| Ethylene thiourea (75%) | 0.27 | 0.27 | 0.27 | 0.27 |

-continued

| | Example | | | |
|---|---|---|---|---|
| | 1 | 2 | 3 | 4 |
| Polyethylene bag | — | 0.69 | — | — |
| Polyvinyl alcohol thread | — | 0.004 | — | — |
| Hot melt adhesive (ethylene/ vinyl acetate copolymer) | — | 0.02 | 0.02 | 0.02 |
| "Elastifilm"[a] bag | — | — | 0.51 | — |
| Surlyn ® 1652[b] bag | — | — | — | 1.2 |

[a]Proprietary polymer from Goodyear
[b]Copolymer of ethylene, vinyl acetate, and methacrylic acid.

EXAMPLES 5-8

A commercial sulfur-modified chloroprene/2,3-dichlorobutadiene-1,3 copolymer was compounded as shown below. Parts are per 100 parts of copolymer.

| | Example | | | |
|---|---|---|---|---|
| | 5 | 6 | 7 | 8 |
| FEF black | 22.5 | 22.5 | 22.5 | 22.5 |
| SRF black | 22.5 | 22.5 | 22.5 | 22.5 |
| Aromatic oil | 8 | 8 | 8 | 8 |
| ZnO | 5 | 5 | 5 | 5 |
| Octylated diphenylamine | 2 | 2 | 2 | 2 |
| MgO | 4 | 4 | 4 | 4 |
| Benzothiazyl disulfide | 0.75 | 0.75 | 0.75 | 0.75 |
| Ethylene thiourea (75%) | 0.27 | 0.27 | 0.27 | 0.27 |
| Polyethylene bag | — | 0.69 | — | — |
| Polyvinyl alcohol thread | — | 0.004 | — | — |
| Hot melt adhesive (ethylene/ vinyl acetate copolymer) | — | 0.02 | 0.02 | 0.02 |
| "Elastifilm"[a] bag | — | — | 0.51 | — |
| Surlyn ® 1652[b] bag | — | — | — | 1.2 |

[a]Proprietary polymer from Goodyear
[b]Copolymer of ethylene, vinyl acetate, and methacrylic acid.

EXAMPLES 9-11

Neoprene W, a homopolymer of chloroprene, was compounded as follows. Parts are per 100 parts of neoprene.

| | Example | | |
|---|---|---|---|
| | 9 | 10 | 11 |
| SRF black | 58 | 58 | 58 |
| Aromatic oil | 10 | 10 | 10 |
| MgO | 4 | 4 | 4 |
| ZnO | 5 | 5 | 5 |
| Thiuram M[a] | 0.5 | 0.5 | 0.5 |
| p-Phenylenediamine | 2 | 2 | 2 |
| Paraffin Wax | 1 | 1 | 1 |
| Stearic Acid | 0.5 | 0.5 | 0.5 |
| Ethylene thiourea (75%) | 1.0 | 1.0 | 1.0 |
| Polyvinyl alcohol thread | — | 0.005 | — |
| Hot melt adhesive (ethylene/ vinyl acetate copolymer) | — | 0.025 | 0.025 |
| Polyethylene bag | — | 0.69 | — |
| Surlyn ® 1652[b] bag | — | — | 1.25 |

[a]Tetramethyl thiuram disulfide.
[b]Copolymer of ethylene, vinyl acetate, and methacrylic acid.

The materials of Examples 1-11 were compounded in a Banbury mixer. The compounded compositions were cured in molds and slab at 160° C. for 20 min except for the compression set pellets which were cured for 25 min, and certain physical properties of the vulcanized polymer were determined according to standard ASTM tests. The results of those tests are given in the following Table.

TABLE

| | Recipe | | | | | |
|---|---|---|---|---|---|---|
| | 1 | 2 | 3 | 4 | 5 | 6 |
| Oscillating Disk Cure Meter 160° C. (ASTM D2084) | | | | | | |
| Minimum (N . m) | 0.59 | 0.59 | 0.57 | 0.72 | 0.40 | 0.34 |
| Scorch time (min) | 5.6 | 5.6 | 5.0 | 5.5 | 5.3 | 5.0 |
| cure developed at cure time (N . m) | 8.64 | 8.05 | 8.38 | 9.03 | 9.30 | 8.99 |
| Cure time (min) | 21.9 | 20.8 | 20.2 | 21.0 | 19.8 | 20.9 |
| Mooney Scorch - 121° C. (ASTM D1646) | | | | | | |
| Minimum (-) | 30.7 | 26.2 | 26.0 | 33.0 | 18.6 | 15.5 |
| Time to 5 point rise (min) | 41.7 | 42.4 | 44.0 | 42.2 | 47.1 | 45.2 |
| Time to 10 point rise (min) | 49.8 | 51.3 | 56.7 | 49.6 | 55.1 | — |
| Stress Strain (ASTM D412) Original | | | | | | |
| Tensile stress at 100% elongation (MPa) | 3.77 | 3.41 | 3.15 | 3.67 | 3.41 | 3.41 |
| Tensile stress at 200% elongation (MPa) | 9.24 | 7.99 | 7.92 | 8.41 | 9.03 | 8.48 |
| Tensile strength at break (MPa) | 19.4 | 15.7 | 16.8 | 16.7 | 21.0 | 18.7 |
| Elongation at break (%) | 406 | 360 | 380 | 373 | 435 | 403 |
| Hardness Shore A (ASTM D2044) | 67 | 69 | 68 | 67 | 66 | 68 |
| Tear Strength - Die C (ASTM D624) (kN/m) | 38.3 | 38.6 | 37.6 | 36.4 | 44.4 | 39.5 |
| Brittle point (ASTM D746) °C. | −38 | −36 | −36 | −38 | −38 | −36 |
| Oil Resistance (% vol swell) (ASTM D471) | | | | | | |
| 70h, 100° C., ASTM oil #3 | 76.9 | 78.1 | 76.3 | 75.6 | 79.4 | 79.9 |
| Fluid Resistance (% vol swell) | | | | | | |

TABLE-continued

| | | | | | | |
|---|---|---|---|---|---|---|
| (ASTM D471) 48h, Ref. Fuel B | 59.7 | 60.5 | 61.5 | 60.3 | 62.5 | 61.7 |
| Clash-Berg, Onset of Torsional Stiffness (ASTM D1053), °C. | −30.2 | −30.0 | −30.0 | −29.8 | −30.0 | −30.6 |
| Compression Set - ASTM D395 (22 hr at 70° C.), % | 29.6 | 29.3 | 25.0 | 31.4 | 24.4 | 27.1 |

| | Recipe | | | | |
|---|---|---|---|---|---|
| | 7 | 8 | 9 | 10 | 11 |
| Oscillating Disk Cure Meter 160° C. (ASTM D2084) | | | | | |
| Minimum (N . m) | 0.37 | 0.42 | 0.40 | 0.40 | 0.38 |
| Scorch time (min) | 5.8 | 5.5 | 4.2 | 4.1 | 4.0 |
| Torque developed at cure time (N . m) | 8.75 | 9.64 | 9.58 | 9.30 | 9.91 |
| Cure time (min) | 20.9 | 20.0 | 22.3 | 23.0 | 23.8 |
| Mooney Scorch - 121° C. (ASTM D1646) | | | | | |
| Minimum (-) | 14.5 | 20.1 | 24.1 | 23.7 | 25.7 |
| Time to 5 point rise (min) | 48.7 | 42.5 | 14.9 | 15.0 | 14.7 |
| Time to 10 point rise (min) | — | 51.1 | 17.9 | 17.9 | 17.8 |
| Stress Strain (ASTM D412) Original | | | | | |
| Tensile stress at 100% elongation (MPa) | 3.20 | 3.98 | 4.39 | 4.34 | 5.42 |
| Tensile stress at 200% elongation (MPa) | 7.99 | 9.72 | 13.6 | 13.7 | 15.0 |
| Tensile strength at break (MPa) | 17.9 | 19.2 | 19.8 | 18.6 | 19.9 |
| Elongation at break (%) | 393 | 390 | 266 | 243 | 253 |
| Aged 3 days at 121° C. | | | | | |
| Tensile stress at 100% elongation (MPa) | — | — | 6.77 | 6.31 | 7.17 |
| Tensile stress at 200% elongation (MPa) | — | — | 16.8 | 16.3 | 16.8 |
| Tensile strength at break (MPa) | — | — | 19.6 | 18.5 | 19.4 |
| Elongation at break (%) | — | — | 230 | 223 | 230 |
| Hardness Shore A (ASTM D2044) | | | | | |
| Original | 68 | 70 | — | — | — |
| Aged 3 days at 121° C. | — | — | 74 | 76 | 77 |
| Tear Strength - Die C (ASTM D624) (kN/m) | 40.2 | 41.1 | 30.0 | 31.1 | 29.0 |
| Brittle Point (ASTM D746), °C. | −34 | −38 | −44 | −46 | −44 |
| Water Resistance - % vol swell ASTM D470 (70° C., 7 days) | — | — | 7.8 | 8.0 | 8.1 |
| Oil Resistance - % vol swell 70h, 100° C., ASTM oil #3 | 78.2 | 77.4 | 57.3 | 59.7 | 58.0 |
| Fluid Resistance - % vol swell 48h, Ref. Fuel B | 61.3 | 61.5 | — | — | — |
| Clash-Berg, Torsional Stiffening, ASTM D1053, °C. | −28.3 | −28.8 | — | — | — |
| Compression Set - ASTM D395 22 hr at 70° C. (%) | 21.1 | 22.8 | — | — | — |

I claim:

1. A method of packaging unvulcanized, talc-treated, solid neoprene pieces for delivery to blending equipment, said method comprising placing the neoprene pieces in a bag made of a thermoplastic material and closing the bag by stitching with a synthetic polymer thread, the polymeric materials of which the bag and the thread are made being readily dispersible in the neoprene at the blending temperature to give a homogeneous dispersion at the weight levels at which they are used, the plastic bag having on a portion of one of its large surfaces a coating of a hot melt adhesive.

2. The method of claim 1 wherein the bag is made of low density polyethylene and the thread is made of polyvinyl alcohol.

3. The method of claim 2 wherein the bag has on a portion of one of its large surfaces a coating of a copolymer of ethylene with vinyl acetate.

4. A package of unvulcanized neoprene suitable for delivery unopened to blending equipment, said package consisting of a bag made of a thermoplastic material filled with solid neoprene pieces and closed with a stitch of a synthetic polymer thread, the materials of which the bag and the thread are made being readily dispersible in the neoprene at the blending temperature to give a homogeneous dispersion at the weight levels at which they are used, the plastic bag having on a portion of one of its large surfaces a coating of a thermoplastic adhesive material.

5. The package of claim 4 wherein the bag is made of low density polyethylene and the thread is made of polyvinyl alcohol.

6. The package of claim 5 wherein a portion of one large surface of the bag is coated with a copolymer of ethylene and polyvinyl acetate.

* * * * *